US006861191B2

(12) United States Patent
Mochizuki et al.

(10) Patent No.: US 6,861,191 B2
(45) Date of Patent: Mar. 1, 2005

(54) DRY TONER FOR DEVELOPING ELECTROSTATIC IMAGES

(75) Inventors: Satoshi Mochizuki, Numazu (JP); Hideki Sugiura, Fuji (JP); Kazuhiko Umemura, Shizuoka-ken (JP); Minoru Masuda, Numazu (JP); Kohsuke Suzuki, Shizuoka (JP); Tomomi Suzuki, Numazu (JP); Yasuo Asahina, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/059,239

(22) Filed: Jan. 31, 2002

(65) Prior Publication Data

US 2002/0155366 A1 Oct. 24, 2002

(30) Foreign Application Priority Data

Jan. 31, 2001 (JP) ..... 2001-024298

(51) Int. Cl.[7] ..... G03G 9/087
(52) U.S. Cl. ..... 430/109.2; 430/109.4
(58) Field of Search ..... 430/109.1, 109.2, 430/109.4

(56) References Cited

U.S. PATENT DOCUMENTS

| | | | | | |
|---|---|---|---|---|---|
| 4,968,575 | A | | 11/1990 | Matsumura et al. | 525/54.4 |
| 5,057,392 | A | | 10/1991 | McCabe et al. | 525/438 |
| 5,840,456 | A | * | 11/1998 | Tomita et al. | 430/109.4 |
| 5,986,017 | A | * | 11/1999 | Katagiri et al. | 430/109.2 |
| 6,258,502 | B1 | | 7/2001 | Nakamura et al. | 399/262 |
| 6,363,229 | B1 | | 3/2002 | Shiraishi et al. | 399/68 |
| 6,368,765 | B2 | * | 4/2002 | Izu et al. | 430/137.2 |
| 6,406,826 | B1 | | 6/2002 | Suzuki et al. | 430/111.35 |
| 6,447,673 | B1 | | 9/2002 | Asami et al. | 430/114 |
| 6,468,706 | B2 | | 10/2002 | Matsuda et al. | 430/108.6 |
| 6,503,681 | B2 | | 1/2003 | Makino et al. | 430/137.2 |

FOREIGN PATENT DOCUMENTS

| | | |
|---|---|---|
| EP | 0 507 373 | 10/1992 |
| WO | WO 97/49006 | 12/1997 |

OTHER PUBLICATIONS

U.S. Appl. No. 10/059,239, filed Jan. 31, 2002, Mochizuki et al.
U.S. Appl. No. 10/609,399, filed Jul. 1, 2003, Katoh et al.
Derwent Publications, AN 1991–083437, XP–002195751, JP 3–028857, Feb. 7, 1991.
Derwent Publications, AN 1998–034031, XP–002195846, JP 62–295068, Dec. 22, 1987.
U.S. Appl. No. 10/385719, filed Mar. 12, 2003, Sugiura, et al.
U.S. Appl. No. 10/391,575, filed Mar. 20, 2003, Suzuki, et al.
U.S. Appl. No. 10/101,756, filed Mar. 21, 2002, Pending.
U.S. Appl. No. 10/059,240, filed Jan. 31, 2002, Pending.
U.S. Appl. No. 09/843,357, filed Apr. 26, 2001, Unknown.
U.S. Appl. No. 09/845,449, filed Apr. 30, 2001, Unknown.
U.S. Appl. No. 10/318,109, filed Dec. 13, 2002, Pending.
U.S. Appl. No. 09/965,826, filed Oct. 1, 2001, Pending.
U.S. Appl. No. 09/964,622, filed Sep. 28, 2001, Pending.
U.S. Appl. No. 09/985,738, filed Nov. 6, 2001, Pending.
U.S. Appl. No. 10/079,878, filed Feb. 22, 2002, Pending.
U.S. Appl. No. 10/086,415, filed Mar. 4, 2002, Pending.
U.S. Appl. No. 10/086,683, filed Mar. 4, 2002, Pending.
U.S. Appl. No. 10/107,157, filed Mar. 28, 2002, Pending.
U.S. Appl. No. 10/151,103, filed May 21, 2002, Pending.
U.S. Appl. No. 10/212,736, filed Aug. 7, 2002, Pending.
U.S. Appl. No. 10/114,056, filed Apr. 3, 2002, Pending.
U.S. Appl. No. 10/077,752, filed Feb. 20, 2002, Pending.
U.S. Appl. No. 10/102,867, filed Mar. 22, 2002, Pending.
U.S. Appl. No. 10/020,925, filed Dec. 19, 2001, Pending.
U.S. Appl. No. 10/077,813, filed Feb. 20, 2002, Pending.
U.S. Appl. No. 10/098,556, filed Mar. 18, 2002, Pending.
U.S. Appl. No. 09/985,368, filed Nov. 2, 2001, Pending.
U.S. Appl. No. 09/985,347, filed Nov. 2, 2001, Pending.
U.S. Appl. No. 09/903,718, filed Jul. 13, 2001, Pending.
U.S. Appl. No. 09/996,585, filed Nov. 30, 2001, Pending.
U.S. Appl. No. 09/988,142, filed Nov. 19, 2001, Pending.
U.S. Appl. No. 09/993,606, filed Nov. 27, 2001, Pending.
U.S. Appl. No. 09/982,877, filed Oct. 22, 2001, Pending.
U.S. Appl. No. 09/942,574, filed Aug. 31, 2001, Allowed.
U.S. Appl. No. 09/985,375, filed Nov. 2, 2001, Pending.
U.S. Appl. No. 09/985,348, filed Nov. 2, 2001, Pending.
U.S. Appl. No. 09/891,652, filed Jun. 26, 2001, Unknown.
U.S. Appl. No. 09/905,872, filed Jul. 17, 2001, Pending.
U.S. Appl. No. 09/820,609, filed Mar. 30, 2001, Pending.
U.S. Appl. No. 09/734,718, filed Dec. 13, 2000, Allowed.
U.S. Appl. No. 09/692,430, filed Oct. 20, 2000, Allowed.
U.S. Appl. No. 10/176,578, filed Jun. 24, 2002, Pending.
U.S. Appl. No. 10/615,770, filed Jul. 10, 2003, Mochizuki, et al.
U.S. Appl. No. 10/636,637, filed Aug. 8, 2003, Hosokawa, et al.

(List continued on next page.)

*Primary Examiner*—Janis L. Dote
(74) *Attorney, Agent, or Firm*—Oblon, Spivak, McClelland, Maier & Neustadt, P.C.

(57) ABSTRACT

A dry toner for developing electrostatic images, including a colorant and a binder resin which comprises a copolymer resin having (A) a polyol resin moiety having a main chain of polyoxyalkylene and obtained by reaction of (a) an epoxy resin, (b) a dihydric phenol, and (c) an alkylene oxide adduct of a dihydric phenol or a glycidyl ether thereof; and (B) a polyester resin moiety obtained by reacting an alkylene oxide adduct of a dihydric phenol or a glycidyl ether thereof with a polycarboxylic acid, wherein the weight ratio of the epoxy resin of the polyol resin moiety (A) to the polyester resin moiety (B) is 95:5 to 60:40, wherein the epoxy resin includes at least two kinds of bisphenol epoxy resins having different number-average molecular weights, and wherein the binder resin has an acid value of not greater than 5.

18 Claims, 1 Drawing Sheet

OTHER PUBLICATIONS

U.S. Appl. No. 10/665,494, filed Sep. 22, 2003, Kawasumi et al.
U.S. Appl. No. 10/667,301, filed Sep. 23, 2003, Tsuda et al.
U.S. Appl. No. 10/742,835, filed Dec. 23, 2003, Tsuda et al.
U.S. Appl. No. 10/740,665, filed Dec. 22, 2003, Nagashima et al.
U.S. Appl. No. 10/752,589, filed Jan. 8, 2004, Masuda et al.
U.S. Appl. No. 10/759,029, filed Jan. 20, 2004, Sugiura et al.
U.S. Appl. No. 10/766,874, filed Jan. 30, 2004, Yamashita et al.
U.S. Appl. No. 10/784,204, filed Feb. 24, 2004, Umemura et al.
U.S. Appl. No. 10/798,871, filed Mar. 12, 2004, Suzuki et al.
U.S. Appl. No. 10/844,442, filed May 13, 2004, Yamashita et al.
U.S. Appl. No. 10/875,402, filed Jun. 25, 2004, Sugiura et al.

* cited by examiner

DRY TONER FOR DEVELOPING ELECTROSTATIC IMAGES

BACKGROUND OF THE INVENTION

This invention relates to a toner for developing electrostatic images and, more particularly, to a toner suitable for use in a one-component developing system and a two-component developing system. The present invention is also directed to a full color image forming apparatus using the above toner.

In a dry electrophotographic system, a copy is obtained by a method including the steps of forming an electrostatic latent image on a photoconductor, developing the electrostatic latent image with a developer to form a toner image, transferring the toner image onto a copying paper, and heat-fixing the toner image (usually with a heat roller). In the case of a full-color image which requires a high gloss and an excellent color tone, a polyester resin as shown in JP-A-S61-7844 or a polyol resin as shown in JP-A-H07-77832 has been frequently used as a binder resin for the toner.

However, the polyester resin tends to cause formation of toner aggregates in a toner bottle or in a vessel of a developing unit, which cause a void phenomenon in the toner image. Also, when a printed image is contacted with a vinyl chloride mat or the like for a long time, the image tends to adhere to the mat or become sticky. Additionally, when the polyester resin has a high acid value, the resulting toner can obtain a high charge potential but has low environmental fluctuation resistance.

A toner containing the polyol resin has a problem because of low chargeability. In particular, when the toner is used as a single-component developer, the low chargeability results in background stains or a low image density. The problem ascribed to the low chargeability may be overcome, when the toner is used as a two-component developer in conjunction with a carrier. However, when the developer is used for an image forming apparatus employing a small-size developing unit in which the amount of the developer contained in a vessel is small, agitation of the developer cannot sufficiently charge the toner because the frictional forces are not sufficiently generated due to the low weight of the developer. Such insufficient charging becomes serious, especially when the image forming machine is a full color type in which the toner concentration in the color developer is higher as compared with that of a black color developer.

SUMMARY OF THE INVENTION

In accordance with one aspect of the present invention, there is provided a dry toner for developing electrostatic images, comprising a colorant and a binder resin, wherein said binder resin comprises a copolymer resin having (A) a polyol resin moiety having a main chain of polyoxyalkylene and obtained by reaction of (a) an epoxy resin, (b) a dihydric phenol, and (c) an alkylene oxide adduct of a dihydric phenol or a glycidyl ether thereof; and (B) a polyester resin moiety obtained by reacting an alkylene oxide adduct of a dihydric phenol or a glycidyl ether thereof with a polycarboxylic acid, wherein the weight ratio of said epoxy resin of said polyol resin moiety to said polyester resin moiety 95:5 to 60:40, wherein said epoxy resin of said polyol resin moiety includes at least two bisphenol epoxy resins having different number-average molecular weights, and wherein said binder resin has an acid value of not greater than 5.

In another aspect, the present invention provides a full color image forming apparatus comprising a toner vessel containing the above dry toner.

It is a first object of the resent invention to provide a toner which can be suitably used both in a one-component developing system and in a two-component developing system employing a small-size developing unit requiring a small amount of a developer and which can give a clear, high density image free of background stains.

A second object of the present invention is to provide a full color toner with which an image having proper and uniform gloss can be produced.

A third object of the present invention is to provide a toner with which an image free from blurs, especially in a half tone area, can be produced.

A fourth object of the present invention is to provide a toner which does not form aggregates during storage in a toner bottle or in a developing unit, which will cause a void phenomenon in the image.

A fifth object of the present invention is to provide a toner which does not adheres to a vinyl chloride mat.

A sixth object of the present invention is to provide a toner having high manufacturability. The term "having high manufacturability" herein means freedom from a possibility that a subject compound cannot be obtained in a satisfactory manner due to a side reaction at the time of production. Moreover, it also means having no sensitizing potential which may give adverse effects to the health and safety of the workers.

BRIEF DESCRIPTION OF THE DRAWINGS

Other objects, features and advantages of the present invention will become apparent from the detailed description of the preferred embodiments of the invention which follows, when considered in light of the accompanying drawing, in which.

DETAILED DESCRIPTION OF THE PREFERRED EMBODIMENTS OF THE INVENTION

Figure 1:
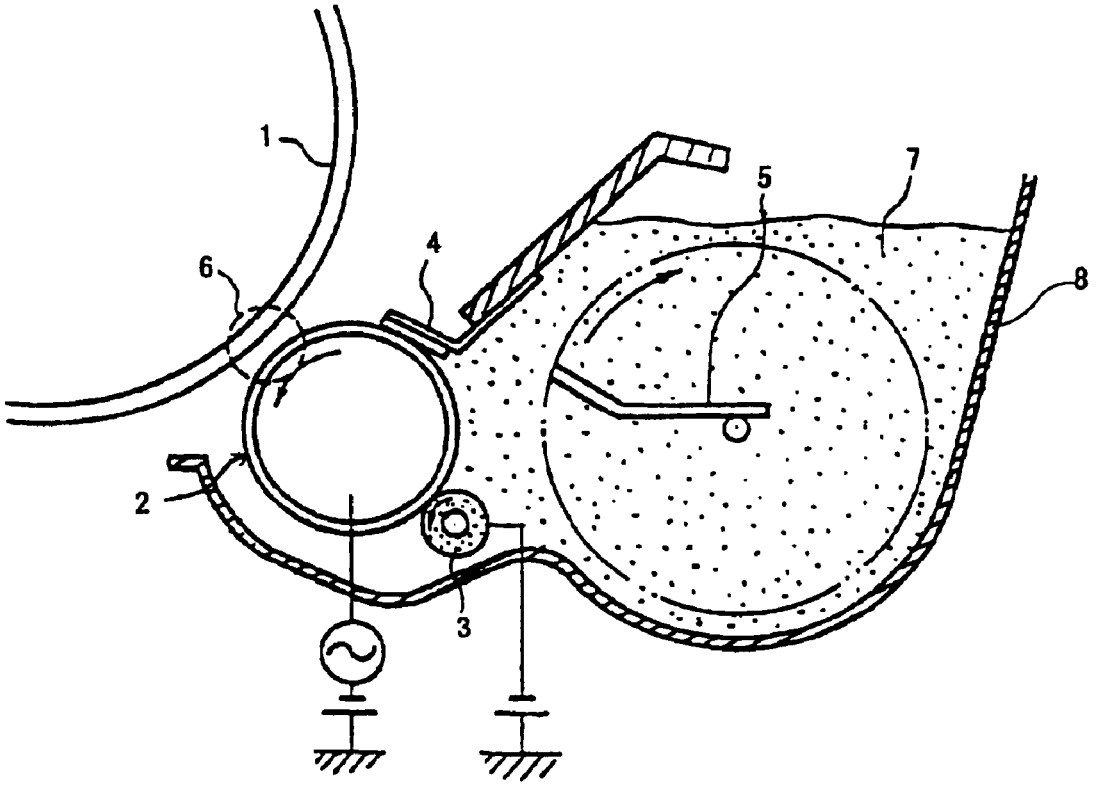
FIG. 1 is a one-component developing unit of an image forming apparatus suitable for embodying the present invention.

Description will be hereinafter made in detail of the present invention. In the present invention, a copolymer resin having (A) a polyol resin moiety which is synthesized by reacting (a) an epoxy resin, (b) a dihydric phenol, and (c) an alkylene oxide adduct of a dihydric phenol or a glycidyl ether thereof and which has a main chain including a polyoxyalkylene part; and (B) a polyester resin moiety which is synthesized by reacting at least an alkylene oxide adduct of dihydric phenol or a glycidyl ether thereof with a polyvalent carboxylic acid is used as a binder resin for a toner which does not cause a void phenomenon and does not adhere to vinyl chloride mat and with which an image with no surface stain and with sufficient image density can be produced when used in a one-component developing system or a two-component developing system requiring a small amount of a developer.

The weight ratio of the epoxy resin constituting the polyol resin moiety (A) to the polyester resin moiety should be 95:5 to 60:40. When the weight ratio is less than 60:40, the resulting toner has low environmental fluctuation resistance and tends to adhere to a vinyl chloride mat. When the weight ratio is greater than 95/5, the resulting toner cannot produce an image of improved quality when used in a one-component developing system or when used as a two-component developer for a full-color image forming apparatus employing a small-size developing unit requiring a small amount of a developer.

The polyol resin in the present invention is a polyether polyol resin having an epoxy skeleton but having no terminal epoxy groups. Since the polyol resin has a polyoxyalkylene part in the main chain thereof, the resulting toner gives an image with a high gloss.

When the polyol resin moiety is composed of at least two kinds of bisphenol A type epoxy resins having different number-average molecular weights, an appropriate molecular weight distribution can be obtained, whereby a clear color image can be produced. In this case, the lower molecular weight component preferably has a number-average molecular weight of 360 to 2,000 and the higher molecular weight component preferably has a number-average molecular weight of 3,000 to 10,000. A molecular weight distribution is represented as a ratio of volume-average molecular weight to a number-average molecular weight. For the purpose of obtaining a color toner having a good gloss, the molecular weight distribution is preferably 3 to 8. The molecular weight distribution may be controlled by controlling the weight ratio of an epoxy resin of the lower molecular weight component and an epoxy resin of the higher molecular weight component for use in the synthesis.

The polyester resin moiety can be synthesized by condensation reaction of, for example, an alkylene oxide adduct of bisphenol A with a polyvalent carboxylic acid, and preferably has a number-average molecular weight of 500 to 2,000.

The copolymer resin used as a binder resin of a toner according to the present invention may be obtained by reaction of (a) an epoxy resin, (b) a dihydric phenol, (c) an alkylene oxide adduct of a dihydric phenol or a glycidyl ether thereof, (d) a polyester resin obtained by reacting an alkylene oxide adduct of a dihydric phenol or a glycidyl ether thereof with a polycarboxylic acid, and (e) a monohydric phenol or a monocarboxylic acid.

The copolymerization may be performed in the presence of a suitable catalyst such as lithium chloride or an amine using a suitable inert organic solvent such as an aromatic hydrocarbon, a ketone, an ether, an ester or an alcohol. A solvent having a relatively high boiling point, such as xylene is preferably used. The reaction may be carried out at a temperature of 50–200° C. for 1–24 hours.

The copolymer resin may also be prepared by reacting (A) a polyol resin having a main chain of polyoxyalkylene and obtained by reaction of (a) an epoxy resin, (b) a dihydric phenol, and (c) an alkylene oxide adduct of a dihydric phenol or a glycidyl ether thereof;

(B) a polyester resin obtained by reacting an alkylene oxide adduct of a dihydric phenol or a glycidyl ether thereof with a polycarboxylic acid; and (C) a diphenol, monophenol or monocarboxylic acid. The reaction may be performed in the same manner as described above.

In the present invention, when the copolymer resin has no epoxy group at termini thereof and has an epoxy equivalent of at least 20,000 is used, a toner free from a sensitizing potential and having high production stability can be obtained. The terminal epoxy groups may disappear when etherized or esterified by a dihydric phenol, monohydric phenol or a monocarboxylic acid.

The copolymer resin of the present invention preferably has a softening point of 100 to 130° C. When the softening point is less than 100° C., the resulting toner is apt to generate aggregates in a toner bottle or developing unit which cause a void phenomenon in a printed image. When the softening point is over 130° C., the resulting toner fails to exhibit sufficient fixability.

It is important that the copolymer resin of the present invention should have an acid value of 5 or less, preferably 1 or less. When the acid value is higher than 5, the resulting toner has a tendency of lacking in stability and causes lowering of static charge amount under high-humidity conditions.

The polyol resin moiety of the copolymer resin of the present invention may be produced from the following compounds.

Examples of the epoxy resin (a) for use in production of the polyol resin moiety include compounds obtained by reacting a bisphenol such as bisphenol A or bisphenol F with epichlorohydrin or its derivative.

Examples of the dihydric phenol (b) include bisphenols such as bisphenol A and bisphenol F.

Examples of the alkylene oxide adduct of a dihydric phenol (c) include reaction products of an alkylene oxide such as ethylene oxide, propylene oxide, butylene oxide or a mixture thereof with a bisphenol such as bisphenol A and bisphenol F. The obtained adduct may be glycidylated with epichlorohydrin or β-methyl epichlorohydrin.

Especially, a diglycidyl ether of alkylene oxide adduct of bisphenol A represented by the following general formula (1) is preferably used:

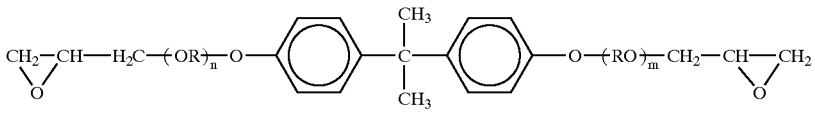

(1)

(wherein R is $—CH_2—CH_2—$, $—CH_2—CH(CH_3)—$ or $—CH_2—CH_2—CH_2—$, n and m are each an integer at least 1 and n+m=2 to 8.)

When (n+m) in the formula (1) is over 8, there is a possibility of deterioration of preservability.

The components (a), (b) and (c) are present at a weight ratio (a):(b):(c) of 25–70:10–40:15–40.

Examples of the monohydric phenol to be reacted with epoxy group include phenol, cresol, isopropylphenol, amylphenol, nonylphenol, dodecylphenol, xylenol and p-cumylphenol.

Examples of the monocarboxylic acid include aromatic monocarboxylic acids such as benzoic acid and an aliphatic monocarboxylic acid such as stearic acid.

The polyester resin moiety of the present invention may be made from the following compounds.

The alkylene oxide adduct of a dihydric phenol or a glycidyl ether thereof for use in production of the polyester resin moiety include reaction products of an alkylene oxide such as ethylene oxide, propylene oxide, butylene oxide or a mixture thereof with a bisphenol such as bispenol A or bisphenol F.

Examples of the polycarboxylic acid for use in production of the polyester resin moiety are as follows.

Specific examples of dicarboxylic acid include aliphatic dicarboxylic acids and derivatives thereof (such as maleic acid, fumaric acid, succinic acid, adipic acid, sebacic acid, malonic acid, azelaic acid, mesaconic acid, citraconic acid, glutaconic acid, octilsuccinic acid, decylsuccinic acid, dodecylsuccinic acid, tetradecylsuccinic acid, hexadecylsuccinic acid, octadecylsuccinic acid, isooctadecylsuccinic acid, hexenylsuccinic acid, octenylsuccinic acid, decenylsuccinic acid, dodecenylsuccinic acid, tetrapropenylsuccinic acid, tetradecenylsuccinic acid, hexadecenylsuccinic acid, isooctadecenylsuccinic acid, octadecenylsuccinic acid, and nonenylsuccinic acid); alicyclic dicarboxylic acids (such as cyclohexanedicarboxylic acid, and methylmedic acid); aromatic dicarboxylic acids (such as phthalic acid, isophthalic, acid, terephthalic acid, toluenedicarboxylic acid, and naphthalenedicarboxylic acid); and anhydrides and lower alkyl (methyl, butyl and so on) esters of the dicarboxylic acids.

Specific examples tricarboxylic acids include trimellitic acid, pyromellitic acid, 1,2,4-cyclohexanetricarboxylic acid, 2,5,7-naphtharenetricarboxylic acid, 1,2,4-naphtharenetricarboxylic acid, 1,2,5-hexanetricarboxylic acid, 1,2,7,8-octanetetracarboxylic acid and acid anhydrides thereof.

These can be used alone or in combination. Such polyfunctional monomers have an effect of improving anti-offset property of the toner by enhancing Tg of a resin and imparting aggrigatability to the resin.

When the Tg is too low, the resulting toner is apt to generate aggregates in a toner bottle or developing unit which cause a void phenomenon in a printed image. When the Tg is too high, it is difficult to obtain sufficient gloss. Thus, the copolymer resin preferably has a Tg of 50 to 70° C., more preferably 55 to 70° C.

Description will be next made of other ingredients for use in the dry toner of the present invention.

The toner of the present invention may be contain a releasing agent for imparting a releasing property to the toner. The releasing agent preferably has a softening point of 70 to 100° C. When the softening point is less than 70° C., the resulting toner has a problem in storage stability. When the softening point is over 100° C., the resulting toner cannot be fixed sufficiently or tends to produce a poor image with, for example, low gloss as a color image.

Specific examples of the releasing agent include synthetic waxes such as low molecular weight polyethylene or polypropylene, and copolymers thereof; vegitable waxes such as candelilla wax, carnauba wax, rice wax, haze wax and jojoba wax; animal waxes such as bees wax, lanolin and spermaceti; mineral waxes such as montan wax and ozocerite; and fat-and-oil type waxes such as hydrogenated castor oil, hydroxystearic acid, fatty acid amides and phenol fatty acid esters.

From the viewpoint of chemical structures of the waxes, hydrocarbon waxes, ester waxes and amide waxes are known. In the present invention, ester type waxes are preferred for reasons of the preservability, image quality, image fixing temperature range and so on.

The releasing agent is preferably added in an amount of 1 to 6% by weight based on a total weight of the toner. When the content of the releasing agent is over 6% by weight, resulting toner has a problem in storage stability or the printed image tends to have a coarse surface with low gloss. When the content of the releasing agent is less than 1% by weight, there tends to be formed a poor color image with a coarse surface and low gloss.

As a colorant, any conventionally known dye or pigment can be used. Examples of dyes and pigments usable as the colorant include carbon black, nigrosine dyes, iron black, NAPHTHOL YELLOW S, HANSA YELLOW (10G, 5G and G), cadmium yellow, yellow iron oxide, loess, chrome yellow, TITAN YELLOW, polyazo yellow, OIL YELLOW, HANSA YELLOW (GR, A, RN and R), PIGMENT YELLOW L, BENZIDINE YELLOW (G and GR), PERMANENT YELLOW (NCG), VULCAN FAST YELLOW (5G and R), TARTRAZINE LAKE, QUINOLINE YELLOW LAKE, ANTHRACENE YELLOW BGL, isoindolinone yellow, red iron oxide, red lead, orange lead, cadmium red, cadmium mercury red, antimony orange, PERMANET RED 4R, PARA RED, FIRE RED, p-chloro-o-nitro aniline red, LITHOL FAST SCARLET G, BRILLIANT FAST SCARLET, BRILLIANT CARMINE BS, PERMANENT RED (F2R, F4R, FRL, FRLL and F4RH), FAST SCARLET VD, VULKAN FAST RUBINE B, BRILLIANT SCARLET G, LITHOL RUBINE GX, PERMANENT RED F5R, BRILLIANT CARMINE 6B, PIGMENT SCARLET 3B, BORDEAUX 5B, TOLUIDINE MAROON, PERMANENT BORDEAUX F2K, HELIO BORDEAUX BL, BORDEAUX 10B, BON MAROON LIGHT, BON MAROON MEDIUM EOSINE LAKE, RHODAMINE LAKE B, RHODAMINE LAKE Y, ALIZARINE LAKE, THIOINDIGO RED B, THIOINDIGO MAROON, OIL RED, quinacridone red, PYRAZOLONE RED, polyazo red, CHROME VERMILION, BENZIDINE ORANGE, perynone orange, OIL ORANGE, cobalt blue, cerulean blue, ALKALI BLUE LAKE, PEACOCK BLUE LAKE, VICTORIA BLUE LAKE, metal-free PHTHALOCYANINE BLUE, PHTHALOCYANINE BLUE, FAST SKY BLUE, INDANTHRENE BLUE (RS, BC), indigo, ultramarine, prussian blue, ANTHRAQUINONE BLUE, FAST VIOLET B, METHYL VIOLET LAKE, cobalt violet, manganese violet, dioxane violet, ANTHRAQUINONE VIOLET, CHROME GREEN, zinc green, chromium oxide, viridian, emerald green, PIGMENT GREEN B, NAPHTHOL GREEN B, GREEN GOLD, ACID GREEN LAKE, MALACHITE GREEN LAKE, PHTHALOCYANINE GREEN, ANTHRAQUINONE GREEN, titanium oxide, zinc oxide, lithopone, and a mixture thereof.

The colorant is generally used in an amount of 0.1 to 50 parts by weight per 100 parts by weight of the binder resin.

The toner of the present invention may additionally contain a charge controlling agent, if desired. As the charge controlling agent, any conventionally known one can be used. Examples of the charge controlling agent include nigrosine dyes, triphenylmethane dyes, chrominum-containing complex dyes, molybdic acid chelate dyes, rhodamine dyes, alkoxyamine, quaternary ammonium salts (including fluorine modified quaternary ammonium salts), alkylamide, phosphorus and compounds thereof, tungsten and compounds thereof, fluorinated type active material, metal salicylates, and metal salts of salicylic acid derivatives.

In addition, the toner of the present invention may contain other additives such as silica powder, metal salts of fatty acids (such as zinc stearate and aluminum stearate), metal oxides (titanium oxide, aluminum oxide, tin oxide and antimony oxide) and fluoropolymers. Especially, hydrophobized silica powder, hydrophobized titania powder and hydrophobized alumina powder are preferred.

Specific examples of the silica powder include HDK H 2000, HDK H 2000/4, HDK H 2050EP and HVK H 1303VP (manufactured by Clarient Corporation), and R972, R974, RX200, RY200, R202, R805 and R812 (manufactured by Nippon Aerosil Co.).

Specific examples of the titania powder include P-25 (manufactured by Nippon Aerosil Co.), STT-30 and STT-65C-S (manufactured by Titan Kogyo K.K. ), TFA-140 (manufactured by Fuji Titan Industry Co., Ltd.), and MT-150W, MT-500B and MT-600B (manufactured by Tayca Corp.).

Especially, as the hydrophobic-treated titanium oxide powder, crystalline titanium oxides including anatase-type titanium oxides and rutile-type titanium oxides, and non-crystalline titanium oxide can be used. Specific examples of the titanium oxide include T-805 (manufactured by Nippon Aerosil Co.), MT-100S and MT-100T, MT-150A, MT-150AFM (manufactured by Tayca Corp.), STT-30A and STT-65S-S (manufactured by Titan Kogyo K.K.), TAF-500T and TAF-1500T (manufactured by Fuji Titan Industry Co., Ltd.) and IT-S (manufactured by Ishihara Sangyo Kaisha Ltd.).

A hydrophobic-treated powder of silica, titania or alumina can be obtained by treating hydrophilic particles thereof with a silane coupling agent such as methyltrimethoxysilane, methyltriethoxysilane, and octyltrimethoxysilane. As the additives, a metal salt of fatty acid (such as zinc stearate and aluminum stearate), a metal oxide (such as alumina, tin oxide and antimony oxide), fluoropolymer and so on may be added.

The toner of the present invention comprising the above ingredients can be used in combination with a carrier as a two-component developer or alone as a one-component developer.

When the toner is used as a two-component developer, any conventionally known carrier such as iron powder, ferrite particles, and glass beads can be used. The carrier particles may be coated with a resin. In this case, any conventionally known resin can be used. Specific examples of the resin include acrylic resins, polycarbon fluoride, polyvinyl chloride, polyvinylidene chloride, phenol resins, polyvinyl acetal and silicon resins.

In general, a toner is mixed with a carrier in an amount of 0.5 to 6.0 parts by weight per 100 parts by weight of the carrier.

The softening point and the glass transition point Tg in the present invention are measured by the following methods. The softening point is measured, using a full-automatic dropping device FP5/FP53 manufactured by Mettler Co., Ltd., in accordance with the following procedure:

(1) A pulverized sample is placed in a crucible and is allowed to stand for 20 minutes. The fused sample was poured into a sample cup (dropping hole diameter: 6.35 mm) up to the brim thereof and allowed to be cooled to room temperature. The cup is then set in a cartridge.

(2) A predetermined heating rate (1° C./min) and a predetermined measurement commencing temperature (which is lower by 15° C. than an expected softening point of the sample) are set by the control unit of FP-5.

(3) The sample-containing cartridge is set in a heating furnace of FP53 and allowed to stand for 30 seconds. Then, the start lever is pulled down to ON to start the measurement. (The measurement is automatically carried out.)

(4) When the measurement is completed, the cartridge is removed.

(5) The softening point (° C.) is calculated by adding a corrective value to the value indicated on the result display panel A of FP-5 (the value indicated in the result display panel A of FP-5+a correction value).

The softening point obtained by adding the corrective value to the value indicated in the result display panel A corresponds to a value obtained by Duran's mercury method. When the measured value indicated on the result display panel A is not greater by 15° C. than the expected softening point (the values indicated on the display panels B and C), the measurement should be conducted again.

The Tg in the present invention is measured, using a differential scanning calorimeter DSC-200, manufactured by Seiko Electronic Inc.), in accordance with the following procedure:

1) A pulverized sample (10 mg±1 mg) is placed in an aluminum sample vessel, which is closed with an aluminum lid.

2) The Tg of the sample is measured in an atmosphere of nitrogen by the DSC (differential scanning calorimeter) method.

Analysis conditions

The sample is heated from room temperature to 150° C. at a heating rate of 20° C./min and then allowed to stand at that temperature for 10 minutes. Then the sample is cooled to 0° C. at a cooling rate of 50° C./min and allowed to stand at that temperature for 10 minutes. The sample is again heated to 150° C. at a heating rate of 20° C./min while feeding nitrogen gas at a rate of 20 cc/min and subjected to the DSC measurement. The Tg (peak rise-up temperature) is determined using an analysis software (Tg Job). The epoxy equivalent is measured by an indicator titration method according to JIS K 7236.

The following examples will further describe the present invention. Parts are by weight. The examples are merely illustrative and are not intended to limit the present invention.

EXAMPLE 1

Preparation of Copolymer Resin

In a separable flask equipped with a stirrer, a thermometer, a $N_2$ feed port and a condenser, 300 g of a low molecular weight bisphenol A/epichlorohydrin epoxy resin (EPOMIK R-140P, manufactured by Mitsui Chemicals Inc., number-average molecular weight: about 360), 150 g of a high molecular weight bisphenol A/epichlorohydrin epoxy resin (EPOMIK R-309, manufactured by Mitsui Chemicals Inc., number-average molecular weight: about 2900), 230 g of a diglycidylate of a bisphenol A type propylene oxide adduct (compound of the above formula (1), in which (n+m) is about 2.1), 240 g of bisphenol A, 90 g of p-cumylphenol, 50 g of a low molecular weight polyester resin (a condensate of bisphenol A type propylene oxide adduct and phathalic anhydride, number-average molecular weight: 1500) and 200 g of xylene were charged. After the contents in the flask had been heated to 70–100° C. in a nitrogen atmosphere, 0.183 g of lithium chloride was added thereto. The mixture was then heated to 160° C. and the xylene was removed by distillation under a reduced pressure. The resulting mixture was then polymerized for 6–9 hours at a reaction temperature of 180° C., thereby obtaining Copolymer Resin 1 (Mn: 4200, Mw/Mn: 6.0, Tg: 60° C., softening point: 105° C., acid value: 0.5, epoxy equivalent: more than 20000).

Preparation of Toners

A mixture of the following ingredients of each color toner was melt-kneaded in a heat roll mill. After cooling, each of the kneaded mixture was roughly ground with a hammer mill and then finely pulverized with an air jet mill. The thus obtained fine particles for each toner were classified to a particle size of about 7 μm, thereby obtaining yellow, magenta, cyan and black toners.

| | |
|---|---|
| Yellow toner: | |
| Copolymer Resin 1 | 100 parts |
| Carnauba wax | 3 parts |
| (ester wax, melting point: about 82° C.) | |
| Yellow pigment | 6 parts |
| (TONER YELLOW HG, manufactured by Clarient Corp.) | |
| E-84, manufactured by Orient Chemical | 2 parts |
| Magenta toner: | |
| Copolymer Resin 1 | 100 parts |
| Carnauba wax | 3 parts |
| Red pigment | 5 parts |
| (LIONOGEN MAGENTA R, manufactured by Toyo Ink Mfg. Co., Ltd.) | |
| E-84, manufactured by Orient Chemical | 2 parts |
| Cyan toner: | |
| Copolymer Resin 1 | 100 parts |
| Carnauba wax | 3 parts |
| Blue pigment | 4 parts |
| (LIONOL BLUE FG-7351, manufactured by Toyo Ink Mfg. Co., Ltd.) | |
| E-84, manufactured by Orient Chemical | 2 parts |
| Black toner: | |
| Copolymer Resin 1 | 100 parts |
| Carnauba wax | 3 parts |
| Black pigment | 6 parts |
| (CARBON BLACK #44, manufactured by Mitsubishi Chemicals Corp.) | |
| E-84, manufactured by Orient Chemical | 2 parts |

Image Forming Test

100 Parts of each of the thus obtained toners was mixed with 0.7 part of hydrophobic silica HDK 2000H (manufactured by Clarient Japan K. K.) as an external additive to obtain yellow, magenta, cyan and black developers of a single-component type. The thus obtained developers were charged in a testing machine having a developing unit as shown in FIG. 1 and a fixing unit having a PFA coated silicon roller having a diameter of 30 mm (set temperature: 160° C.). Continuous printing was conducted on 99 sheets of A4 size paper at a processing rate of 75 mm/sec. When evaluation was conducted, good quality images without image deterioration were produced on all the 99 sheets. The average gloss of yellow, magenta, cyan and black solid images was 18%. Printing was also conducted under conditions of 30° C. and 80% RH (relative humidity). No deterioration was observed in the printed image. Papers on each of which a single-color image of yellow, magenta, cyan and black was printed were interposed between vinyl chloride mats and allowed to stand for 8 hours at 50° C. under a load of 1 kg. The toners did not adhere to the vinyl chloride mats. The gloss of the image was herein measured using a gloss meter (VG-1D, manufactured by Nippon Denshoku Kogyo Co., Ltd.) with an incident angle of 60° C., a reflection angle of 60° and S—S10 switch set at S, and in a standard mode.

In FIG. 1, designated as 1 is a latent image bearing member such as a photoconductor drum. Disposed adjacent to the photoconductor drum 1 is a developer bearing member 2 such as a developing cylinder to define a developing zone 6 therebetween. The developing cylinder 2 is adapted to carry a toner 7 contained in a vessel 8 and to convey the toner 7 to the developing zone 6, so that the latent image on the photoconductive drum 1 is developed with the toner. A developer regulating member 4 such as an elastic blade is provided to regulate the amount of the toner carried and conveyed by the developing cylinder 2. Designated as 5 a stirrer blade and as 3 is a toner supplying member such as a sponge roller for feeding the toner 7 to the developing cylinder 2.

EXAMPLE 2

Preparation of Toners

Yellow, magenta, cyan and black toners having an average particle size of 7 μm were prepared from the following ingredients in the same manner as that in Example 1. Copolymer Resin 2 was synthesized in the same manner as that for the preparation Copolymer Resin 1 in Example 1 except that the weight ratio of the epoxy resin of the polyol resin moiety to the polyester resin moiety was changed to 95:5. Physical properties of the Copolymer Resin 2 were summarized in Table 1.

| | |
|---|---|
| Yellow toner: | |
| Copolymer Resin 2 | 100 parts |
| Yellow pigment | 6 parts |
| (TONER YELLOW HG, manufactured by Clarient Corp.) | |
| E-84, manufactured by Orient Chemical | 2 parts |
| Magenta toner: | |
| Copolymer Resin 2 | 100 parts |
| Red pigment | 5 parts |
| (LIONOGEN MAGENTA R, manufactured by Toyo Ink Mfg. Co., Ltd.) | |
| E-84, manufactured by Orient Chemical | 2 parts |
| Cyan toner: | |
| Resin 2 | 100 parts |
| Blue pigment | 4 parts |
| (LIONOL BLUE FG-7351, manufactured by Toyo Ink Mfg. Co., Ltd.) | |
| E-84, manufactured by Orient Chemical | 2 parts |
| Black toner: | |
| Resin 2 | 100 parts |
| Black pigment | 6 parts |
| (CARBON BLACK #44, manufactured by Mitsubishi Chemicals Corp.) | |
| E-84, manufactured by Orient Chemical | 2 parts |

Image Forming Tests 0.5 Part of hydrophobic silica (R972 manufactured by Nippon Aerosil Co.) and 0.3 part of hydrophobic titania (STT-30A manufactured by Titan Kogyo K.K.) as external additives were mixed with 100 parts of each of the obtained toners. 5 Parts of each color toner was mixed with 95 parts of a carrier obtained by coating spherical ferrite particles having an average diameter of 50 μm with a silicon resin, thereby obtaining two-component developers of yellow, magenta, cyan and black. The four color developers were charged in a commercially available color electrophotographic copying machine (PRETER 550, manufactured by Ricoh Company Ltd.) and 99 copies were continuously produced. When evaluation was conducted, good quality images without image deterioration had been produced on all the 99 sheets. The average gloss of yellow, magenta, cyan and black solid images was 17%. Also, printing was conducted under conditions of 30° C. and 80% RH, no image deterioration was observed. Papers on each of which a single color image of yellow, magenta, cyan and black were interposed between vinyl chloride mats and allowed to stand for 8 hours at 50° C. under a load of 1 kg. The toners did not adhere to the vinyl chloride mats.

EXAMPLE 3

Coplymer Resin 3 was prepared in the same manner as in Example 1 except that trimellitic acid was used in place of phthalic anhydride. Physical properties of the thus obtained Copolymer Resin 3 are summarized in Table 1. Then, yellow, magenta, cyan and black toners (average particle size: 7 $\mu$m) were prepared in the same manner as in Example 1 except that Copolymer Resin 3 was used in place of Copolymer Resin 1.

0.5 Part of hydrophobic silica (R972 manufactured by Nippon Aerosil Co.) and 0.3 part of hydrophobic titania (STT-30A manufactured by Titan Kogyo K.K.) as external additives were mixed with 100 parts of each of the thus obtained toners. 3 Parts of each toner was mixed with 97 parts of a carrier obtained by coating spherical ferrite particles having an average diameter of 50 $\mu$m with a silicon resin, thereby obtaining two-component developers of yellow, magenta, cyan and black. The developers were charged in a commercially available electrophotographic copying machine (IMAGIO MF2700, manufactured by Ricoh, Company, Ltd.) and 99 copies were continuously produced. When evaluation was conducted, good quality images without image deterioration had been produced on all the 99 sheets. Printing was also conducted under conditions of 30° C. and 80% RH. No image deterioration was observed. Papers on each of which a single color image of yellow, magenta, cyan and black were printed were interposed between vinyl chloride mats and allowed to stand for 8 hours at 50° C. under a load of 1 kg. The toners did not adhere to the vinyl chloride mats.

EXAMPLE 4

Example 2 was repeated in the same manner as described except that Copolymer Resin 2 was substituted by Copolymer Resin 4 which was synthesized in the same manner as that for the preparation Copolymer Resin 1 in Example 1 except that the weight ratio of the epoxy resin of the polyol resin moiety to the polyester resin moiety was changed to 60:40. Physical properties of the Copolymer Resin 4 were as summarized in Table 1.

EXAMPLE 5

Example 2 was repeated in the same manner as described except that Copolymer Resin 2 was substituted by Copolymer Resin 5 which was synthesized in the same manner as that for the preparation Copolymer Resin 1 in Example 1 except that the polymerization temperature and time were changed so that the acid number of Copolymer Resin 5 was increased to 4. Physical properties of the Copolymer Resin 5 were as summarized in Table 1.

COMPARATIVE EXAMPLE 1

Example 1 was repeated in the same manner as described except that Copolymer Resin 1 was substituted by Comparative Resin 1 which was synthesized in the same manner as that for the preparation Copolymer Resin 1 in Example 1 except that no polyester resin was used; i.e. the weight ratio of the epoxy resin of the polyol resin moiety to the polyester resin moiety was changed to 100:0. Physical properties of the Comparative Resin 1 were as summarized in Table 1.

COMPARATIVE EXAMPLE 2

Example 2 was repeated in the same manner as described except that Copolymer Resin 2.was substituted by Comparative Copolymer Resin 2 which was synthesized in the same manner as that for the preparation Copolymer Resin 1 in Example 1 except that the weight ratio of the epoxy resin of the polyol resin moiety to the polyester resin moiety was changed to 50:50. Physical properties of the Comparative Copolymer Resin 2 were as summarized in Table 1.

COMPARATIVE EXAMPLE 3

Example 2 was repeated in the same manner as described except that Copolymer Resin 2 was substituted by Comparative Copolymer Resin 3 which was synthesized in the same manner as that for the preparation Copolymer Resin 1 in Example 1 except that the polymerization temperature and time were changed so that the acid number of Comparative Copolymer Resin 3 was increased to 8. Physical properties of the Comparative Copolymer Resin 3 were as summarized in Table 1.

COMPARATIVE EXAMPLES 4 and 5

Example 3 was repeated in the same manner as described except that Copolymer Resin 3 was substituted by Comparative Copolymer Resin 4 (in Comparative Example 4) or Comparative Copolymer Resin 5 (in Comparative Example 5) which was synthesized in the same manner as that for the preparation of Copolymer Resin 3 in Example 3 except that the trimellitic acid of the polyester resin was replaced by phthalic anhydride and that the epoxy resin for the polyol resin moiety was the high molecular weight epoxy resin R-309 alone (Comparative Example 4) or the low molecular weight epoxy resin R-140P alone (Comparative Example 5). Physical properties of the Comparative Copolymer Resins 4 and 5 were as summarized in Table 1.

TABLE 1

Physical Properties of Copolymer Resins

| Example No. | Epoxy resin/ Polyester | Carboxylic acid of Polyester | Acid value | Mn | Mn/ Mw | Tg | Softening point |
|---|---|---|---|---|---|---|---|
| 1 | 90/10 | Phthalic anhydride | 0.5 | 4200 | 6.0 | 60 | 105 |
| 2 | 95/5 | Phthalic anhydride | 0.3 | 4350 | 5.9 | 60 | 105 |
| 3 | 90/10 | Trimellitic acid | 0.8 | 5850 | 8.5 | 64 | 118 |
| 4 | 60/40 | Phthalic anhydride | 0.5 | 4280 | 5.1 | 62 | 113 |
| 5 | 90/10 | Phthalic anhydride | 4 | 4440 | 5.7 | 60 | 106 |
| Comptv. Ex. 1 | 100/0 | | | 4100 | 5.3 | 60 | 107 |
| Comptv. Ex. 2 | 50/50 | Phthalic anhydride | 0.8 | 4420 | 5.8 | 61 | 117 |

TABLE 1-continued

Physical Properties of Copolymer Resins

| Example No. | Epoxy resin/ Polyester | Carboxylic acid of Polyester | Acid value | Mn | Mn/ Mw | Tg | Softening point |
|---|---|---|---|---|---|---|---|
| Comptv. Ex. 3 | 90/10 | Phthalic anhydride | 8 | 4050 | 6.2 | 61 | 108 |
| Comptv. Ex. 4 | 90/10[1)] | Phthalic anhydride | 0.6 | 4300 | 5.3 | 64 | 111 |
| Comptv. Ex. 5 | 90/10[2)] | Phthalic anhydride | 0.2 | 3880 | 4.9 | 59 | 103 |

[1)]R-309 alone
[2)]R-140P alone

Each of the toners of Examples 1–5 and Comparative Examples 1–5 was tested for background fogging (Test (1)), image uniformity (Test (2)), aggregation (Test (3)), image void or white spot (Test (4)), adhesion to vinyl chloride (Test (5)) and environmental fluctuation resistance (Test (6)). In the background fogging test, background stains by the continuous printings were evaluated. In the uniformity test, uniformity at half-tone areas of the image was evaluated. In the aggregation test, the degree of aggregation of toner after storage for 48 hours at 50° C. was evaluated. In the void test, white spots in solid area of the image were evaluated. In the adhesion test, the adhesion of the image-bearing paper to a vinyl chloride mat after having been left for 8 hours at 50° C. under pressure was evaluated. In the environmental fluctuation resistance test, the image density of the image formed at 30° C. under 80% relative humidity was evaluated. The evaluation was rated according to the following ratings:

A: utterly no problem
B: almost no problem
C: some problems but in permissible level
D: some problems in impermissible level
E: significant problems The test results are summarized in detail in Table 2.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

TABLE 2

Test Results

| | Test (1) | Test (2) | Test (3) | Test (4) | Test (5) | Test (6) | Apparatus |
|---|---|---|---|---|---|---|---|
| Example 1 | B | B | B | B | A | A | Test machine |
| Example 2 | B | A | A | A | A | A | PRETER 550 |
| Example 3 | B | B | B | B | A | A | MF 2700 |
| Example 4 | A | B | C | C | C | A | PRETER 550 |

TABLE 2-continued

Test Results

| | Test (1) | Test (2) | Test (3) | Test (4) | Test (5) | Test (6) | Apparatus |
|---|---|---|---|---|---|---|---|
| Example 5 | B | B | B | B | A | C | PRETER 550 |
| Comp. Ex. 1 | D | B | A | A | A | A | Test machine |
| Comp. Ex. 2 | A | D | E | E | D | A | PRETER 550 |
| Comp. Ex. 3 | B | B | B | B | A | E | PRETER 550 |
| Comp. Ex.4 | A | E | A | A | A | A | MF 2700 |
| Comp. Ex.5 | A | A | E | E | A | A | MF 2700 |

Remarks:
Test (1): background fogging
Test (2): image uniformity
Test (3): aggregates
Test (4): image void (white spot)
Test (5): adhesion to vinyl chloride
Test (6): environmental fluctuation resistance

What is claimed is:

1. A dry toner for developing electrostatic images, comprising a colorant and a binder resin, wherein said binder resin comprises a copolymer resin having (A) a polyol resin moiety having a main chain of polyoxyalkylene and obtained by reaction of (a) an epoxy resin, (b) a dihydric phenol, and (c) an alkylene oxide adduct of a dihydric phenol or a glycidyl ether thereof; and (B) a polyester resin moiety obtained by reacting an alkylene oxide adduct of a dihydric phenol or a glycidyl ether thereof with a polycarboxylic acid, wherein the weight ratio of said epoxy resin of said polyol resin moiety to said polyester resin moiety is 95:5 to 60:40, wherein said epoxy resin of said polyol resin moiety includes at least two bisphenol epoxy resins having different number-average molecular weights, and wherein said binder resin has an acid value of not greater than 5.

2. A dry toner as claimed in claim 1, wherein said binder resin has an epoxy value of at least 20,000.

3. A dry toner as claimed in claim 1, wherein said binder resin has an acid value of not greater than 1.

4. A dry toner as claimed in claim 1, wherein said polycarboxylic acid of said polyester resin moiety is a dicarboxylic acid.

5. A dry toner as claimed in claim 1, wherein said epoxy resin of said polyol resin moiety is a mixture of a lower molecular weight epoxy resin having a number-average molecular weight of 360 to 2,000 and a higher molecular weight epoxy resin having a number-average molecular weight of 3,000 to 10,000.

6. A dry toner as claimed in claim 1, wherein said polyester resin moiety has a number-average molecular weight of 500 to 2,000.

7. A dry toner as claimed in claim 1, wherein said copolymer resin is obtained by reaction of (a) an epoxy resin, (b) a dihydric phenol, (c) an alkylene oxide adduct of a dihydric phenol or a glycidyl ether thereof, (d) a polyester resin obtained by reacting an alkylene oxide adduct of a dihydric phenol or a glycidyl ether thereof with a polycarboxylic acid, and (e) a monohydric phenol or a monocarboxylic acid.

8. A dry toner as claimed in claim 1, wherein the copolymer resin has a softening point of 100 to 130° C.

9. A dry toner as claimed in claim 1, wherein (a), (b) and (c) are present in an (a):(b):(c) weight ratio of 25–70:10–40:15–40.

10. A dry toner as claimed in claim 1, wherein the copolymer resin has a Tg of 50 to 70° C.

11. A dry toner as claimed in claim 1, wherein the copolymer resin has a Tg of 55 to 70° C.

12. A dry toner as claimed in claim 1, further comprising a releasing agent having a softening point of 70 to 100° C.

13. A dry toner as claimed in claim 1, further comprising a releasing agent in an amount of 1 to 6% by weight based on the total weight of the toner.

14. A dry toner as claimed in claim 1, wherein the colorant is present in an amount of 0.1 to 50 parts by weight per 100 parts by weight of the binder resin.

15. A dry toner as claimed in claim 1, further comprising a charge controlling agent.

16. A two component developer, comprising the dry toner as claimed in claim 1 and a carrier.

17. A two component developer as claimed in claim 16, wherein the toner is present in an amount of 0.5 to 6.0 parts by weight per 100 parts by weight of the carrier.

18. A two component developer as claimed in claim 16, wherein the carrier is in the form of particles coated with a resin.

* * * * *